United States Patent [19]

Barnes

[11] Patent Number: 4,947,552

[45] Date of Patent: Aug. 14, 1990

[54] FOLDING KNIFE WITH POSITIVE LOCK

[75] Inventor: Gary L. Barnes, New Windsor, Md.

[73] Assignee: Barnes International Cutlery, New Windsor, Md.

[21] Appl. No.: 349,044

[22] Filed: May 8, 1989

[51] Int. Cl.[5] ..... B26B 1/04

[52] U.S. Cl. ..... 30/161; 30/159; 30/160

[58] Field of Search ..... 30/160, 161, 158, 159

[56] References Cited

U.S. PATENT DOCUMENTS

| | | | |
|---|---|---|---|
| 458,664 | 9/1891 | Scholz | 30/161 |
| 1,075,519 | 10/1913 | Tillmans | 30/159 |
| 1,512,689 | 10/1924 | Hermann | 30/161 |
| 1,521,778 | 1/1925 | McLay | 30/161 |
| 4,502,221 | 3/1985 | Pittman | 30/161 X |
| 4,730,394 | 3/1988 | Sonner, Jr. | 30/161 |

*Primary Examiner*—Frank T. Yost
*Assistant Examiner*—Rinaldi Rada
*Attorney, Agent, or Firm*—Robert O. Richardson

[57] ABSTRACT

A folding knife with positive lock for maintaining the knife blade selectively within the handle case and in open position. A spring urged foot engages appropriate locking notches on the blade for open and closed positions to render the blade immobile in either position. A thumb actuated rocker (several embodiments are disclosed) releases the foot from contact with the notch and out of the path of blade rotation. In an alternate form a pull ring may be used as the lock release. A positive stop on the knife blade abuts the handle case when the blade is in closed position to facilitate movement to its open position when the foot has been removed from the closed locking notch.

7 Claims, 2 Drawing Sheets

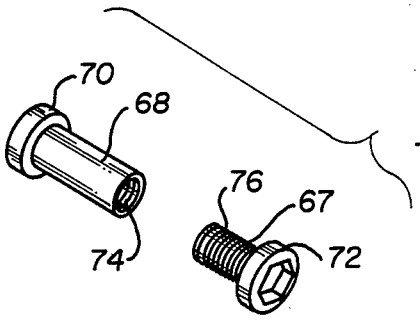
Fig 5
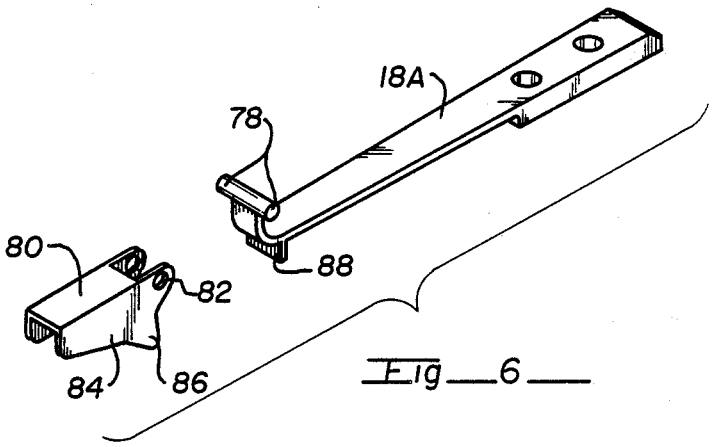
Fig 6
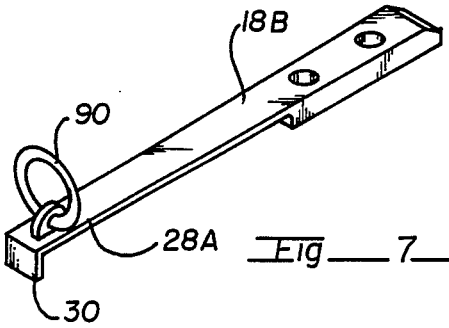
Fig 7
Fig 8
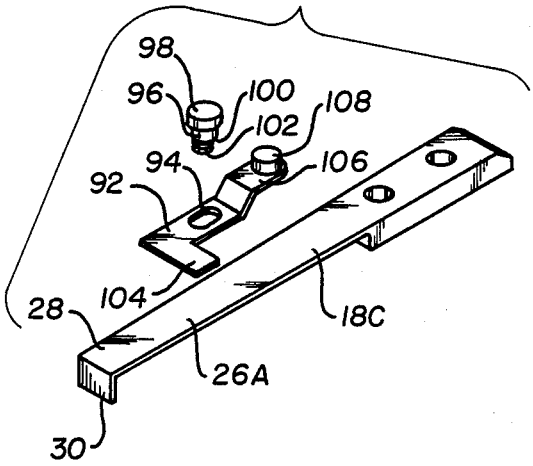
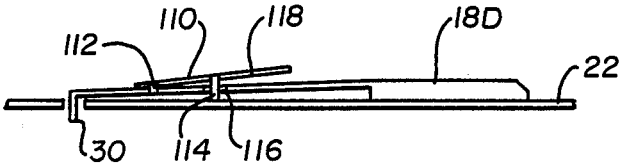
Fig 9

FOLDING KNIFE WITH POSITIVE LOCK

FIELD OF THE INVENTION

The present invention relates to folding knives and locking means for keeping the knife blade in open or closed position as desired and to facilitate blade movement between these positions.

BACKGROUND OF THE INVENTION

Conventional folding knives ordinarily have a blade with a tang pivoted at one end to one of the ends of the knife housing that constitutes a handle. A friction type rib or spring keeps the blade in closed position. The blunt edge of the blade must be gripped and tugged to pull the blade from its closed or stored position. Some blades have an exposed groove along the blunt edge to receive an operator's fingernails as he tugs the blade open. Spring latching mechanisms or cams for temporarily locking the blade in open position are relatively weak such that minor forces or nudges override the latching mechanisms. This creates a dangerous condition in which the blade will collaspe upon the unwary operator's hand, cusing pain and injury.

There is one type of knife that has a positive lock of the blade in open position. This is done by means of a resilient rib on the back edge having a locking end engaging a notch in the end of the tang on the blade. The other end of the rib, or trigger, when depressed pivots and releases the locking end from the tang of the blade, freeing the blade to be moved to its closed position. The blade is frictionally retained in closed position and thus has the same problem in opening as the others. Such a knife cannot be disassembled or easily cleaned.

BRIEF SUMMARY OF PRESENT INVENTION

In accordance with the present invention a folding knife is provided with a positive lock on the blade in both open and closed positions. With no frictional latching or retaining mechanisms, once unlocked, the blade is free to move easily between open and closed positions and the locking mechanism of the present invention then holds the blade securely in its new position.

Briefly, the blade has a pair of locking notches on the tang, one for closed position and one for open position. A resilient beam or spring mounted on the knife handle case has an inwardly directed foot that passes through the case to engage the notches on the tang portion of the knife blade. This spring has a release button which, when depressed, will pry the foot out of contact with the blade notch, freeing the blade to be rotated from one position to another. When the release button is no longer depressed, the spring foot engages the blade notch again, locking the blade in its new position. To assist in opening and closing the blade, a positive stop extends outwardly from the knife blade. It also engages the edge of the handle case when the blade is closed, to limit inward movement of the blade into the handle case beyond that permitted when the spring foot engages the closed position notch.

A principle feature of the present invention is the simplicity and ease in releasing the blade with the type of bottom release used. Another feature is in the economy in the manufacture of a knife made in accordance with the present invention. Another is in its ready disasssembly for cleaning, repair and exchange of parts when needed. A knife thus manufactured is inexpensive, durable reliable and has a useful life of many years.

BRIEF DESCRIPTION OF THE DRAWINGS

FIG. 5 is an exploded view in perspective of a two screw assembly pivot pin, FIG. 6 is an exploded view in perspective of an alternate release rocker, FIG. 7 is a perspective view of another form of release rocker spring, FIG. 8 is an exploded perspective view of another form of release rocker, and FIG. 9 is a side view of another form of release.

DESCRIPTION OF PREFERRED EMBODIMENTS

Figure 1:
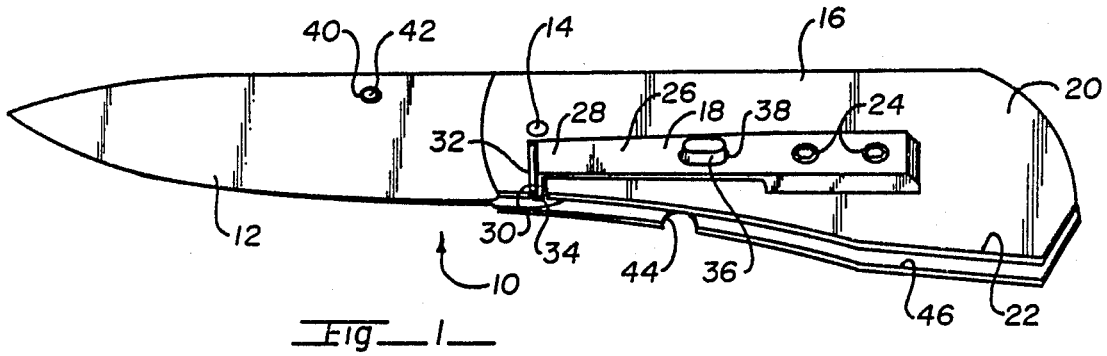
FIG. 1 is a perspective view of the knife with its blade in open position.

Reference is now made to FIG. 1 wherein knife 10 is shown in perspective with its blade 12 pivotally mounted at pivot pin 14 to one end of channel case handle 16. The blade 12 is locked in open position. A resilient bridge beam spring 18 is mounted on the outside surface 20 of the upper side 22 of handle 16 by means of socket head machine screws 24. The beam spring 18 has a greater thickness at the end where the machine screws 24 fasten it to the upper side 22 of handle 16 in order to raise the thinner resilient bridge area 26 from contact with surface 20. At the free end 28 of spring 18 is a downwardly directed foot 30 that passes through a slot 32 in the upper side 22 of handle 16. This foot 30 engages a notch 34 in the surface of the tang of blade 12 to lock the blade 12 in open position. A release button 36 extends upwardly through opening 38. When button 36 is depressed, foot 30 is raised out of notch 34 and the blade 12 is free to be moved to its closed position. A threaded hole 40 has a socket head machine screw 42 inserted on the underside of blade 12. This screw 42 provides a positive blade stop when the blade 12 is in closed position by abutting a blade stop recess 44 on the edge of lower side 46. The screw head also acts as an opening aid in pulling the blade 12 back to its open position.

Figure 2:
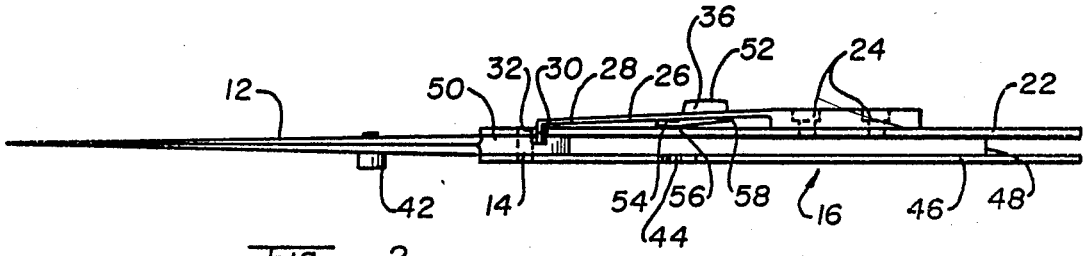
FIG. 2 is an edge view of the knife.

An edge view of the knife 10 is shown in FIG. 2 with blade 12 locked in open position. Here machine screw 42 is shown attached to the blade 12 from its underside. The blade 12 is pivotally connected at pivot pin 14 to one end of a channel case handle 16 having a lower side 46, upper side 22 and connecting rib 48. The channel case preferably is of 0.049 mild stainless steel and is die pressed into its channel shape with the connecting rib 48 of a width slightly more than the thickness on the blade tang 50. The head of machine screw 42 on blade 12 extends downwardly beyond the blade tang 50 so that it will abut recess 44 in the lower side 46 to provide a positive blade stop when the blade is in closed position.

The operation of release button 36 can best be seen in FIG. 2. As previously mentioned with reference to FIG. 1, the resilient beam spring 18 is fastened at its thicker end to the upper side 22 of handle 16 by means of socket head machine screws 24. Its free end 28 has a downwardly directed foot 30 that passes through slot 32 in the handle upper side 22. This foot 30 engages surface notch 34 in blade tang 50 to lock blade 12 in open position, all as shown in FIGS. 1 and 2. Release button 36 extends up through an opening 38 in the thinner area 26 of the spring 18. When the release button 36 is depressed, the free end 28 of the spring is raised and foot 30 is disengaged from notch 34, permitting blade 12 to be moved from its locked open position. The configuration of release button 36 for accomplishing this is best seen in FIG. 2. The release button 36 has an upper depress area 52 that extends above opening 38 in spring 18. Under spring 18 is a forward extending toe 54, a handle side contacting pivot 36 and a catch 58. Catch 58 engages the undersurface of the beam spring 18 to maintain the release button in position and prevents accidental removal of the button. It should be noted that pivot 56 is in vertical alignment with the leading edge of the upper depress area 52 so that any downward depression on area 52 will cause a rocking motion at pivot 56. This causes toe 54 to move upwardly against the undersurface of the thinner bridge area 26, lifting foot 30 upwardly out of contact with notch 34 in blade tang 50. This permits blade 12 to be moved between its open and closed positions.

Figure 3:
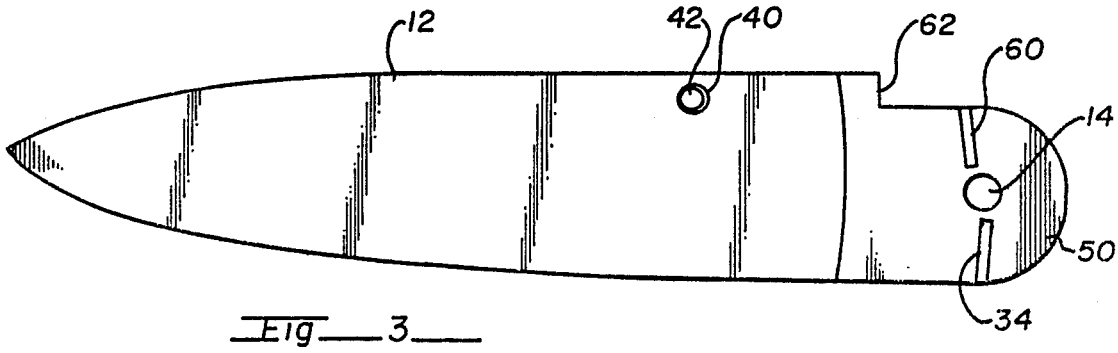
FIG. 3 is a plan view of the side of the knife blade.

As shown in FIG. 3, blade tang 50 has a first notch 34 in its surface used in locking blade 12 in open position. It has a second radially extending notch 60 shown here to be diametrically opposite pivot 14 from the first notch 34. However, the handle configuration will determine the position of the blade in its closed position. Thus, the second notch is positioned to receive foot 30 when blade 12 is in the desired closed position. When this occurs, machine screw head 42 engages recess 44 in the lower side 46 of the channel shown in FIG. 2 to limit movement of the blade 12 into handle 16. Blade 12 also has a blade stop 62 on tang 50 which abuts end 64 of rib 48 of handle 16, shown in FIG. 4.

Figure 4:
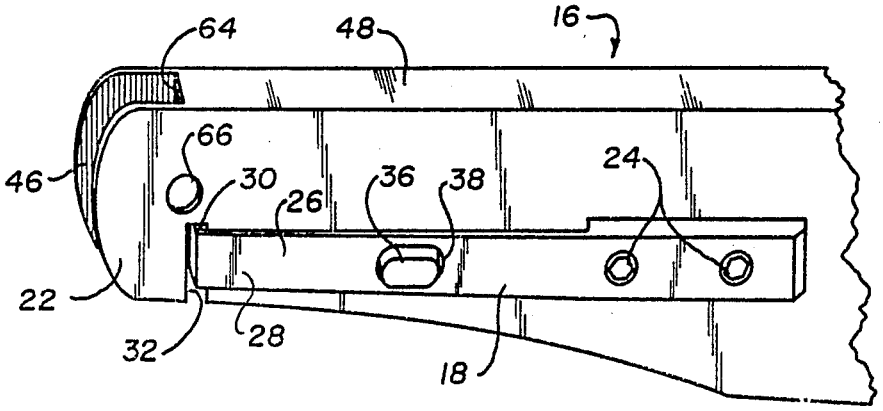
FIG. 4 is a partial view of the channel case handle in perspective.

In FIG. 4 can be seen handle 16 which consists of sides 22, 46 and connecting rib 48. When pivot 14 of blade 12 in FIG. 3 is aligned with openings 66 at the ends of sides 22, 46 and held in place with a pin, or screw assembly shown in FIG. 5, foot 30 on spring 18 engages radial notch 34 on blade tang 50 and blade stop 62 abuts end 64 of rib 48. When blade 12 is in closed position, foot 30 of spring 18 engages radial notch 60 on tang 50 of blade 12. It should be noted that the front of spring foot 30 engages tang notch 34 at a slight angle of a few degrees. Either the back edge of foot 30 can be slightly angled or beveled to provide a wedging action against the leading edge of notch 60 or, if desired, the leading edge of notch 60 may be angled so as to provide the wedging action. This constant pressure against the forward (toward the blade point) edge of notch 34 and keeps blade stop 62 in firm contact with end 64 of connecting rib 48. Thus, when in locked open position, the lock is firm with no sloppy play between the blade and handle. These wedging actions are built in to assure that the knife self-adjusts for wear and to assure a precision fit. In the locked closed position, screw head 42 on blade 12 bears against the open edge of underside 46 of the handle case. The back edge of spring foot 30 is recessed, putting pressure on the leading edge (toward the blade point) of notch 60. The back edges of the tang notches have no function in the locking of the blade in either open or closed position.

Spring 18 is best made by milling from flat stock. After millng the spring is easily bent down so that the point where foot 30 and the end 28 of the spring form an inside corner is slightly below the base line of the spring's mounting surface. This is done before heat treating. This simple bending operation eliminates the need to mill tapered surfaces, sets the proper tension on the spring , establishes the proper angle on the leading edge of the foot, and allows use of $\frac{1}{8}''$ stock for the spring.

The pivot pin 14 that pivotally connects the blade 12 in FIG. 3 with its handle 16 in FIG. 4 is preferably in the form of the two part screw assembly shown in FIG. 5. This assembly comprises a male threaded screw 67, female threaded screw 68 combination. The inner surfaces of their heads 70, 72 may be compressed to adjust the side tension of the handle case, shown in FIG. 4, against the blade tang, shown in FIG. 3. This provides adjustable ease of rotating the blade and promotes proper alignment of the parts.

The length of the female threaded cylinder 74 is equal to the total thickness of the blade tang 50, in FIG. 3, and one of sides 22 or 46, in FIG. 4, minus approximately 0.005 inch for tension adjustment. The length of the male threaded shaft 76 should be sufficient length to hold the cylinder 74 without bottoming out inside the cylinder. A "locktight" type of thread adhesive may be used on the threads to avoid relative rotation until desired. At that time rotational pressure may be used to break the bond by twisting the screws appropriately with an appropriate tool for the type of screw heads 70, 72. Head 72 shown is an Allen head but it may be of a socket type, Phillips head, single slot or a decorative type as desired.

FIGS. 6, 7, 8, and 9 show alternate forms of springs and release mechanisms. Generally they are more narrow and do not have an opening in the thin resilient portion. Identical parts have identical numbers, similar parts have similar numbers followed by a letter (such as 18A), and new components have other numbes. In FIG. 6 beam spring 18A has a pair of ears 78 at its free end onto which a release rocker 80 may be pivotally mounted. This rocker preferably is formed from channel stock and has an aperture 82 on each side 84 which may be sprung over the ears 78 at its free end. Sides 84 have downward projections 86 which engage the outer surface of the side 22 of handle 16, shown in FIG. 2. When release rocker 80 is depressed, projections 86 move downwardly against the upper side 22 of handle 16 and thus pull foot 88 upwardly and away from either notch 34 or notch 60 of blade 12 in FIG. 3 to permit rotation of blade 12 between its open and closed positions.

FIG. 7 shows another form of release rocker spring 18B wherein a pull ring 90 is mounted on the free end 28A so that an upward pull on the ring will free the foot 30 from the notch on the blade tang.

FIG. 8 is an exploded perspective view of another form of release rocker 18C that is similar to the first one described except that there is no opening in which an upper depress area protrudes. Instead, a release lever 92 is mounted along the side of the bridge thinner area 26 on the knife handle side 22 in FIGS. 1, 2, and 3. This lever 92 has an elongated opening 94 to receive the shaft 96 of a socket head machine screw 98 and to permit rocking movement of the release lever 92 thereover. The shaft section 92 of the screw 98 terminates at a shoulder 100 and a smaller threaded portion 102. The shoulder engages the upper surface of knife handle side 22 in FIG. 2 and allows the screw to be torqued down while permitting the release lever 92 to move freely.

The release lever 92 has a laterally extending tongue 104 forward of opening 94. This tongue fits under the thinner area 26A of the beam spring 18C to raise it and free its foot 30 from the notches in the blade tang shown in FIG. 3. The portion 106 of release lever 92 rearwardly of opening 94 is raised from the outer surface of handle side 22 so that the release lever 92 may be rocked or pivoted in a clockwise direction in FIG. 8. If desired, a release button 108 may be added to this elevated portion 106.

FIG. 9 is a side view of another form of release having economical advantages in manufacture. Here bridge beam spring 18D is mounted on upper side 22 of the handle, as in other embodiments. A release lever arm 110 has its forward end 112 loosely riveted to the bridge beam spring 18D. At some intermediate point along lever arm 110 a rocker pin 114 is affixed thereto and extends downwardly through an opening 116 in beam spring 18D and bears against the outer surface of upper side 20 of the handle. The rear end 118 may be depressed to lift the locking foot 30 from its locking recess on blade 12 in FIG. 3 to permit movement of the blade between its open and closed positions.

After reviewing the preferred embodiments just described, the economy of manufacture, the simplicity of assembly and disassembly for cleaning, repair and maintenance purposes, and the functional utility, durability and dependability of the knife of the present invention should be readily apparent. Modifications and variations of the embodiments just described will become obvious to those skilled in the art (such as placing the locking structure on the back of the knife handle instead of on the handle side, for example, and reversing parts as needed or desired). It is to be understood that these deviations are considered to be part of this invention as set forth in the following claims.

What is claimed is:

1. A positive locking folding knife comprising:

a knife blade, a handle, said blade having a tang with a pivotal connection to said handle, said tang having notches extending radially from said pivotal connection on one side of said tang, a resilient bridge beam spring having a thicker end attached to a side of said handle, said bridge having a resilient thinner area raised from contact with said side, said bridge having a free end terminating said bridge having a free end terminating in an inwardly directed foot, said foot engaging one of said notches when said blade is in its open position, said foot engaging another of said notches when said blade is in its closed position, and lift means to lift said foot from said notches and out of the path of said tang when rotation between open and closed positions is desired.

2. A positive locking folding knife as in claim 1, said lift means including a release button, said bridge having an opening in its thinner area through which a depress area of said release button protrudes outwardly, said depress area having a toe and pivot structure connected thereto, said toe contacting the underside of said thinner area when said button is depressed and said pivot structure pivots on the side surface of said handle.

3. A positive locking folding knife as in claim 1, said lift means including at least one ear in the free end of said beam, a release rocker pivotally mounted on said ear, thereon, at least one downwardly directed projection on said rocker engageable with the surface of said handle whereby downward movement of said rocker causes upward movement of said foot.

4. A positive locking folding knife as set forth in claim 1, wherein said lift means includes a pull ring on said free end which may be manually pulled upwardly to lift said foot out of said notch and out of the path of tang rotation.

5. A positive locking folding knife as set forth in claim 1, said lift means comprising a release lever pivotally mounted on said handle adjacent said bridge resilient thinner area, said release lever having a laterally extending tongue under said thinner area, said release lever having a raised portion which, when depressed, causes said release lever to pivot and raise said tongue against said thinner area to lift said foot out of said notch and out of the path of tang rotation.

6. A positive locking folding knife as in claim 1, said foot engaging one of said notches with a rearward tilt to urge snug contact between said projection on said blade and said handle when said blade is in closed position.

7. A positive locking folding knife as in claim 1, wherein said handle comprises two sides and an interconnecting rib, said blade having a stop on the edge of said tang, said stop abutting said rib at an end thereof when said blade is in open position, said spring foot engaging a tang notch at a slight angle of a few degrees to exert pressure on the forward edge of said notch and thus maintaining firm contact of said stop with said rib end.

* * * * *